United States Patent [19]

Carlin

[11] 4,060,436

[45] Nov. 29, 1977

[54] METHOD OF MARKING FOR GARMENT PATTERN

[76] Inventor: Eunice A. Carlin, 322 N. Mississippi Blvd., St. Paul, Minn. 55104

[21] Appl. No.: 746,483

[22] Filed: Dec. 1, 1976

[51] Int. Cl.[2] ..... B44C 1/24

[52] U.S. Cl. ..... 156/63; 2/243 B; 33/12; 156/293

[58] Field of Search ..... 156/63, 293; 2/243 R, 2/243 B; 33/11, 12, 174 B

[56] References Cited

U.S. PATENT DOCUMENTS

| | | | |
|---|---|---|---|
| 1,747,323 | 2/1930 | Sadtler | 33/12 |
| 2,411,328 | 11/1946 | MacNab | 33/12 |
| 3,772,114 | 11/1973 | Kowalchuk | 156/94 |

*Primary Examiner*—Edward G. Whitby
*Attorney, Agent, or Firm*—Leo Gregory

[57] ABSTRACT

This invention relates to a garment pattern and more particularly to the markings thereon. It is a common practice to use pins or tailor tacks to place markings on the material underlying a garment pattern corresponding with specified markings on the pattern such as the matching points of the pattern and to indicate darts, pleats, button hole locations and the like. Pins damage the pattern and are time consuming to make. The improvement herein consists of using small self-adhesive marking members of different configurations to indicate markings on the pattern and to be positioned onto the material through appropriate apertures or openings formed in the pattern. These marking members are readily applied and removed and vary in configuration so that corresponding marking members are readily matched up in assembling the material to form a garment.

3 Claims, 6 Drawing Figures

FIG. 1
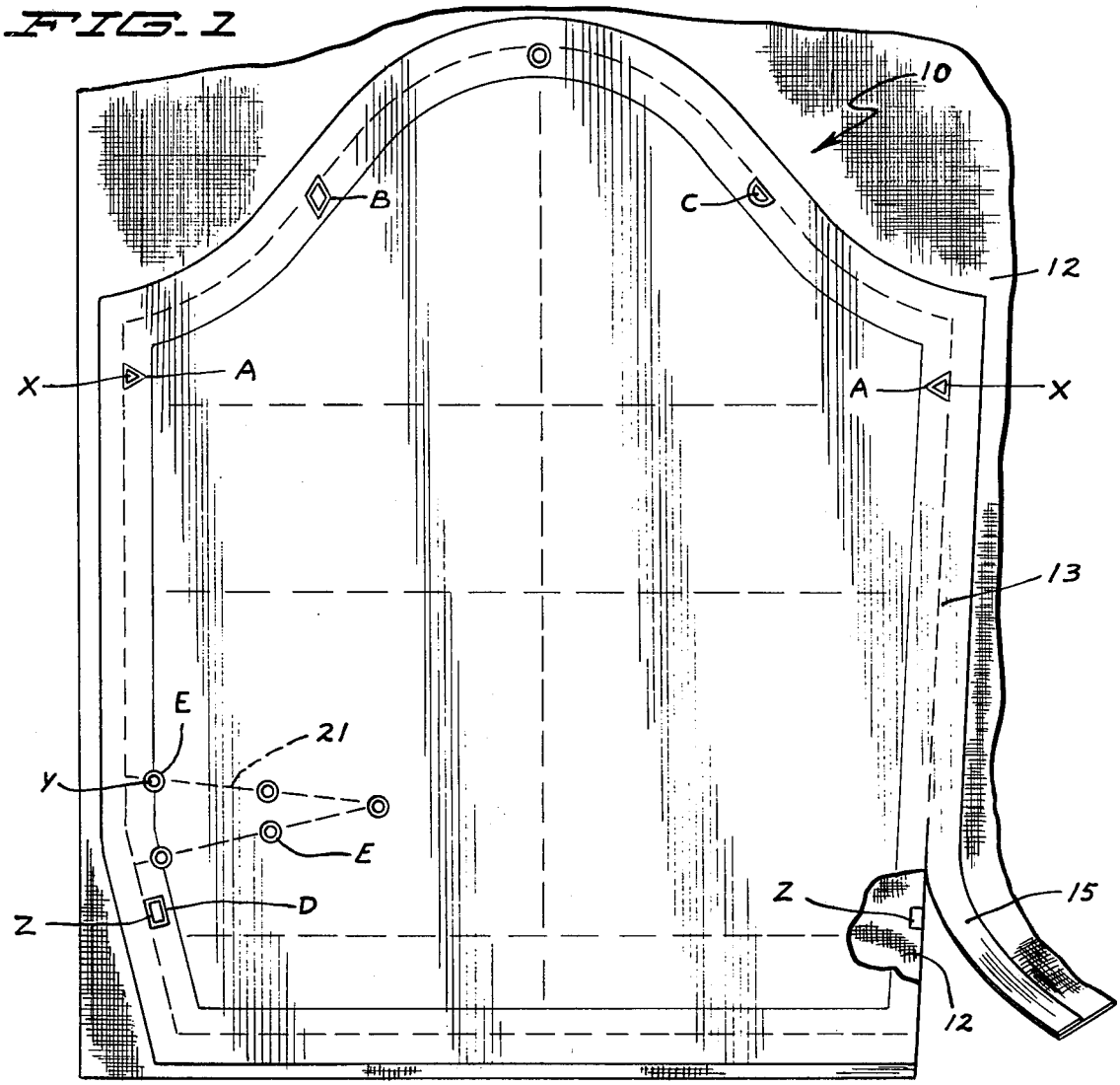
FIG. 6
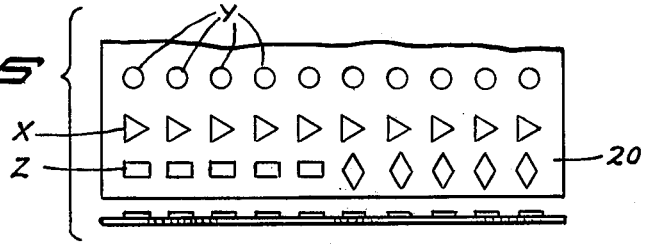
FIG. 2
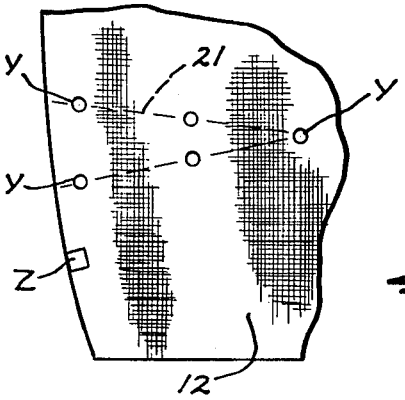
FIG. 3
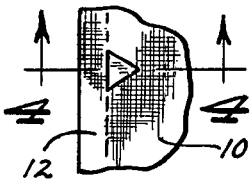
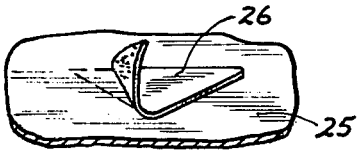
FIG. 5
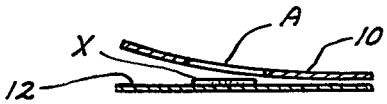
FIG. 4

METHOD OF MARKING FOR GARMENT PATTERN

BACKGROUND AND SUMMARY OF THE INVENTION

In the practice of using a garment pattern, the pattern is laid out onto the material to be used to have the material cut up into pieces corresponding with the various pieces of the pattern. The pattern has as indications thereon corresponding matching points to fit the pieces together. In addition to matching points, there are indications on the pattern for making darts, pleats, button holes and the like.

Pins and tailor tacks are commonly used to place markings on the material to correspond to the indications present on the pattern. A more convenient means is provided by the invention herein for marking material.

The invention herein as its principal object provides self-adhesive or self-sticking marking members of various configurations and those of like configuration are placed on the material at corresponding match up points. A specified configuration of a marking member may be used to indicate the location and design of darts and pleats and appropriate marking members will indicate the location of button holes.

The marking members are placed about the perimeter of the pattern onto the material for match up points. The pattern will be appropriately apertured to permit marking members to be placed through the pattern to indicate dart and pleat locations, button hole locations and the like.

It is also an object of this invention to provide a pattern having marking members carried on the underside thereof which may be secured to underlying material by the application of heat or by the removal of cover strips from said members to expose their adhesive surfaces.

These and other objects and advantages of the invention will be set forth in the following description made in connection with the accompanying drawings in which like reference characters refer to similar parts throughout the several views and in which:

FIG. 1 is a plan view of a piece of a garment pattern overlying a piece of material;

FIG. 2 is a broken view of a piece of material showing marking members thereon;

FIG. 3 is a broken view in plan of a detail of a pattern overlying a piece of material;

FIG. 4 is a view in vertical section taken on line 4—4 of FIG. 3 as indicated;

FIG. 5 is a broken view in perspective showing a modification; and

FIG. 6 is a broken composite view in plan and in elevation showing an assembly of marking members.

DESCRIPTION OF A PREFERRED EMBODIMENT

Referring to the drawings, a piece 10 of a garment pattern is shown overlying a piece of material 12. It will be understood that there are other pieces to comprise the pattern as a whole though not here shown. The dotted line 13 of the pattern is the line on which the underlying material is cut about the pattern as indicated at 15. This is the common practice.

The pattern matching points A-D are indicated on the pattern. Each reference character A-D on the perimeter of the pattern indicates a match up point with a corresponding match up point on the same piece of the pattern or with another piece of the general pattern. Each match up point is shown having a distinct configuration and those which will be matched up have like configurations.

The reference character E indicates marking points formed as circular apertures which are arranged to show the formation of a dart. The pattern is apertured at each point as indicated in FIG. 4 and an appropriate marking member such as the member X on the sheet 20 of marking members will be removed from the sheet, the cover strip protecting the adhesive surface of the marker, if one is used, will be removed and the marker will be positioned through the aperture of the pattern, such as aperture A, and the same will be secured onto the underlying material. In like manner the dart 21 will be indicated by marking members on the underlying material by having said members, such as the marking members Y, positioned through the five apertures indicated as E.

It will be understood that there will be marking members of a sufficiently different number of configurations for the various different markings generally present on a pattern.

In FIG. 5, a modification is indicated in which a marking member 26 is applied to a pattern 25 in making up the pattern and will be attached to the underlying surface thereof. The marking member may either be secured to the underlying material by the application of a heated iron in pressing it onto the underlying material or it may be provided as with a cover strip not here shown which may be removed to expose the adhesive surface and in being secured to the underlying material the member 26 will be peeled away from the pattern.

In the use of the pattern marking members of this invention there is no rupturing or tearing of the pattern and the marking members may be removed at any convenient time from the material. The marking members are all readily and quickly positioned and remain secured to the material.

The pattern may be made to have appropriate apertures pre-formed therein or the apertures may be initially cut-out by the user prior to the application of the pattern to the material.

There is substantial benefit gained by the use of the marking members of the invention herein in not requiring the pattern itself to be ruptured or torn by the application of pins and tailor tacks and in providing secure readily seen and clearly distinguishable marking members.

It will of course be understood that various changes may be made in the steps and sequence of steps of the method without departing from the scope of applicant's invention which, generally stated, consists in a method capable of carrying out the objects above set forth, such as disclosed and defined in the appended claims.

What is claimed is:

1. A method of applying markings onto material corresponding to garment pattern markings consisting of the steps of a. forming apertures in a garment pattern at each marking point on said pattern, b. forming corresponding of said apertures to have like configurations, c. overlying material with said pattern, d. forming marking members of material having an adhesive surface, e. configuring said marking members to conform to said apertures, and f. disposing said marking members through like of said apertures to secure the same therethrough to said underlying material.

2. The method set forth in claim 1, wherein a. said marking members have a cover strip overlying the adhesive surface thereof, and b. said cover strips are removed from said marking members in applying the same to said material.

3. A method of applying markings onto material corresponding to garment pattern markings consisting of the steps of a. overlying material with a garment pattern, b. forming marking members of a material having an adhesive surface, c. having one of said marking members in connection with said pattern for each marking point on said pattern, d. corresponding of said marking points having like configurations, and e. said marking members respectively corresponding in configuration to their respective marking points of said pattern.

* * * * *